US009516930B2

(12) United States Patent
Izkovitz

(10) Patent No.: US 9,516,930 B2
(45) Date of Patent: Dec. 13, 2016

(54) FRESHENING RINGS

(76) Inventor: Gdalyahu Izkovitz, Brooklyn, NY (US)

( * ) Notice: Subject to any disclaimer, the term of this patent is extended or adjusted under 35 U.S.C. 154(b) by 195 days.

(21) Appl. No.: 13/463,138

(22) Filed: May 3, 2012

(65) Prior Publication Data

US 2013/0014312 A1 Jan. 17, 2013

Related U.S. Application Data

(63) Continuation-in-part of application No. 13/180,888, filed on Jul. 12, 2011, now Pat. No. 8,747,002.

(60) Provisional application No. 61/560,983, filed on Nov. 17, 2011.

(51) Int. Cl.

| | |
|---|---|
| ***A44C 9/00*** | (2006.01) |
| ***A45D 40/18*** | (2006.01) |
| ***A45D 40/22*** | (2006.01) |
| ***A41D 19/00*** | (2006.01) |
| ***A45F 5/00*** | (2006.01) |
| *A45D 34/00* | (2006.01) |

(52) U.S. Cl.

CPC ..... *A44C 9/0069* (2013.01); *A41D 19/0024* (2013.01); *A45D 40/18* (2013.01); *A45F 5/00* (2013.01); *A45D 2034/005* (2013.01); *A45F 2005/008* (2013.01)

(58) Field of Classification Search

CPC ..... A44C 9/00; A44C 9/0053; A44C 9/0061; A44C 9/0069; A44C 25/00; A44C 25/001; A44C 25/002

USPC ..... 63/1.14, 1.11, 15

See application file for complete search history.

(56) References Cited

U.S. PATENT DOCUMENTS

| | | | | | |
|---|---|---|---|---|---|
| 292,963 | A | * | 2/1884 | Thie | 63/1.15 |
| 1,334,859 | A | * | 3/1920 | Herbert | 63/15 |
| 1,404,536 | A | * | 1/1922 | Maculskiys | G04B 37/12 224/903 |
| 1,607,985 | A | * | 11/1926 | Johnson | 224/221 |
| 1,609,481 | A | * | 12/1926 | McCarthy et al. | 224/219 |
| 1,731,092 | A | * | 10/1929 | Birnbaum | 63/15 |
| 1,731,190 | A | * | 10/1929 | Birnbaum | 63/15 |
| 1,823,814 | A | * | 9/1931 | Aiello | 132/301 |
| 1,889,862 | A | * | 12/1932 | Bond | A44C 17/0208 40/639 |
| 1,949,755 | A | * | 3/1934 | Mitchell | 2/159 |
| 2,079,043 | A | * | 5/1937 | Samstag | 63/1.15 |
| 2,357,697 | A | * | 9/1944 | Slater | 63/15 |
| 2,970,379 | A | * | 2/1961 | Hardgrove | 433/163 |
| 3,006,350 | A | * | 10/1961 | Grunfeld | 132/297 |
| 3,559,854 | A | * | 2/1971 | Loveland | A44C 5/003 132/294 |
| 5,732,862 | A | * | 3/1998 | Bull | 224/217 |

(Continued)

*Primary Examiner* — Emily Morgan

(74) *Attorney, Agent, or Firm* — Ostrager Chong Flaherty & Broitman P.C.

(57) ABSTRACT

A wearable freshening ring assembly comprises a fixed or flexible ring shank portion, integrally or mechanically connected to a personal care product receptacle, which is mechanically or frictionally connected to a personal care product capsule and a protective cap element. The ring shank portion is sized to fit a wearer's finger or is adjustable to fit a wearer's finger. The ring is made from formable materials such as jewelry grade metals and costume jewelry grade materials selected from non-precious metals, thermoformable plastic resins, ceramics, leather, rubber, and flexible plastics, and include in their construction fabrics, woven materials and the like.

12 Claims, 5 Drawing Sheets

(56) References Cited

U.S. PATENT DOCUMENTS

| | | | | | |
|---|---|---|---|---|---|
| D427,379 | S | * | 6/2000 | Thorpe | D28/77 |
| 6,076,679 | A | * | 6/2000 | Yuhara | A45C 13/008 132/294 |
| D429,383 | S | * | 8/2000 | Thorpe | D28/77 |
| D435,939 | S | * | 1/2001 | Thorpe et al. | D28/77 |
| 6,192,895 | B1 | * | 2/2001 | Yuhara | A45C 13/008 132/294 |
| D625,216 | S | * | 10/2010 | Morgan | D11/26 |
| 2008/0245104 | A1 | * | 10/2008 | Steele | 63/1.12 |
| 2010/0083701 | A1 | * | 4/2010 | Huynh | 63/15.6 |
| 2012/0030909 | A1 | * | 2/2012 | Moore | A44C 9/0084 24/3.12 |
| 2012/0060861 | A1 | * | 3/2012 | Van Cleef | A45D 33/33 132/316 |
| 2012/0176774 | A1 | * | 7/2012 | Hermann, II | G08B 5/36 362/103 |
| 2015/0216285 | A1 | * | 8/2015 | Grainger | A45D 40/18 206/581 |

* cited by examiner

Cartridge Insert

Cartridge Inserted

Cartridge Open

FRESHENING RINGS

CROSS REFERENCE TO RELATED APPLICATION

This application is a continuation-in-part of U.S. patent application Ser. No. 13/180,888 filed Jul. 12, 2011, and is related to the provisional application Ser. No. 61/560,983 filed Nov. 17, 2011, the priority of which is claimed for any subject matter of the provisional application not contained in application Ser. No. 13/180,888.

FIELD OF THE INVENTION

The present invention relates to a ring construction adapted to facilitate use of personal care products by a wearer of the ring.

BACKGROUND OF THE INVENTION

Consumers use a variety of personal care products which include, without limitation, lip and skin balms, lotions, ointments, sunscreens and treatments, as well as a variety of cosmetic products such as lipstick and glosses.

Often it is necessary to apply or reapply such products at frequent intervals and this sometimes necessitates application at inconvenient times.

Further, depending upon environmental circumstances, it is sometimes a nuisance to carry the required products at all times.

It will be recognized that there is a need for a convenient cartridge for such personal care products which not only contains the required components, but facilitates the ready availability of such products whenever necessary. It would be an additional advantage of that the required components be replaceable when they have been used up. To have such convenient availability as well as convenient applicators will be seen as an advantage over prior designs. The present invention relates to a ring construction adapted to facilitate use of personal care products by a wearer of the ring.

All of the foregoing advantages can be accomplished with the ring construction described herein.

SUMMARY OF THE INVENTION

The present invention relates to a ring construction adapted to facilitate use of personal care products by a wearer of the ring. For instance, a replaceable chap stick or lipstick capsule may be combined with a receptacle in a ring assembly as described in detail below. It will be seen that the subject device can be useful for lip gloss, balms, lotions and ointments, ski products, sun screen products and the like. Furthermore, the ring assembly is equally useful indoors as well as outdoors.

The ring is worn by the user for convenient application of the contents. A cover is removed from the ring applicator to expose the contents contained in the replaceable capsule configured for insertion in a receptacle element of the ring. The contents may then be used directly as an applicator avoiding contact with the user's fingers.

A variety of materials may be used for the components in the subject design. The solid receptacle, capsule and cap components will typically be thermoformed from thermoplastic resins selected for strength style and durability. These may include polyolefin, polyamide and polyester resins among others. Of course it will be possible to make these components as well as a solid shank portion from formable metals including jewelry grade precious metals such as gold and silver and other less expensive metals (copper, aluminum, alloys thereof, etc.). Other designs may utilize a flexible strap in place of a solid shank. Flexible straps will typically be leather, rubber, flexible plastic or fabrics, wovens and molded thermoplastics.

A freshening ring may also have a decorative setting, cap or other embellishments. The decoration may be or be combined with the cap for the contents. It is contemplated that the convenience of the subject device can be fashionable as well as useful.

In addition to being attractive, the ring provides for the renewable storage and transport of the contents thereof, which cannot be readily lost and which is simple to use. The contents, i.e., lip gloss, balm, makeup, chap stick and the like can be readily accessed by removing or releasing the cover to expose the contents of the capsule in the ring receptacle, after which it may be used directly as an applicator, avoiding contact with the wearer's fingers and without removal from the wearer's hand.

Other objects, features and advantages of the present invention will be apparent when the detailed descriptions of the preferred embodiments of the invention are considered and are to be construed in an illustrative and not limiting sense as follows:

DETAILED DESCRIPTION OF THE PREFERRED EMBODIMENTS

The subject wearable ring assembly comprises a fixed or flexible ring shank portion, integrally or mechanically connected to a personal care product receptacle described herein as a receptacle. The receptacle is configured to receive and contain a replaceable capsule of the personal care product. The capsule is additionally configured to have a closure, typically a snap cap, for covering and protecting the personal care contents. The receptacle will be mechanically or frictionally connected to the capsule and the protective cap element. The ring shank portion is sized to fit a wearer's finger or is adjustable to fit a wearer's finger. The ring may be made from a variety of materials as may be desired for expense, attractiveness or convenience, such as jewelry grade materials selected from precious metals such as gold and silver or costume jewelry grade materials selected from non-precious metals, thermo-formable plastic resins, ceramics, leather, rubber, fabrics or woven materials.

The personal care product capsule may be smooth or may further have at least one friction inducing protrusion for facilitating storage of a personal care product in the receptacle. The personal care product capsule or receptacle may have a means for connecting and holding secure the protective cap, such as by a friction fitting, or a snap-cap fitting. Furthermore, the cap may be a decorative cap, or a decoration may be attached to a regular cap.

The subject wearable ring assembly may further comprise a personal care product in the capsule. The personal care product may be a skin care product, a lip care product, or any personal or therapeutic lotion, ointment, balm, gloss or cosmetic product.

Figure 1:
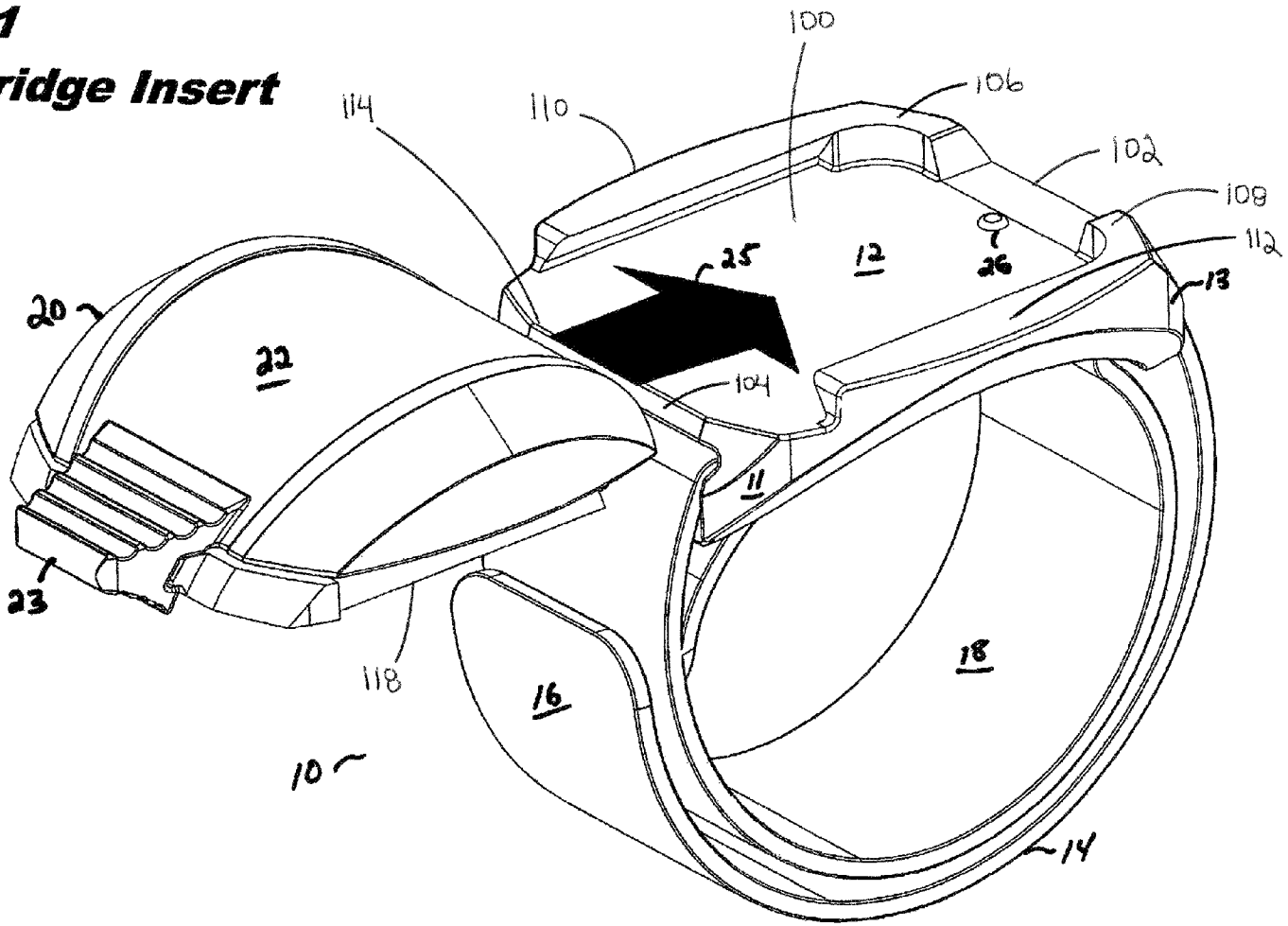
FIGS. 1-3 are perspective details of an embodiment of the subject invention.
Figure 2:
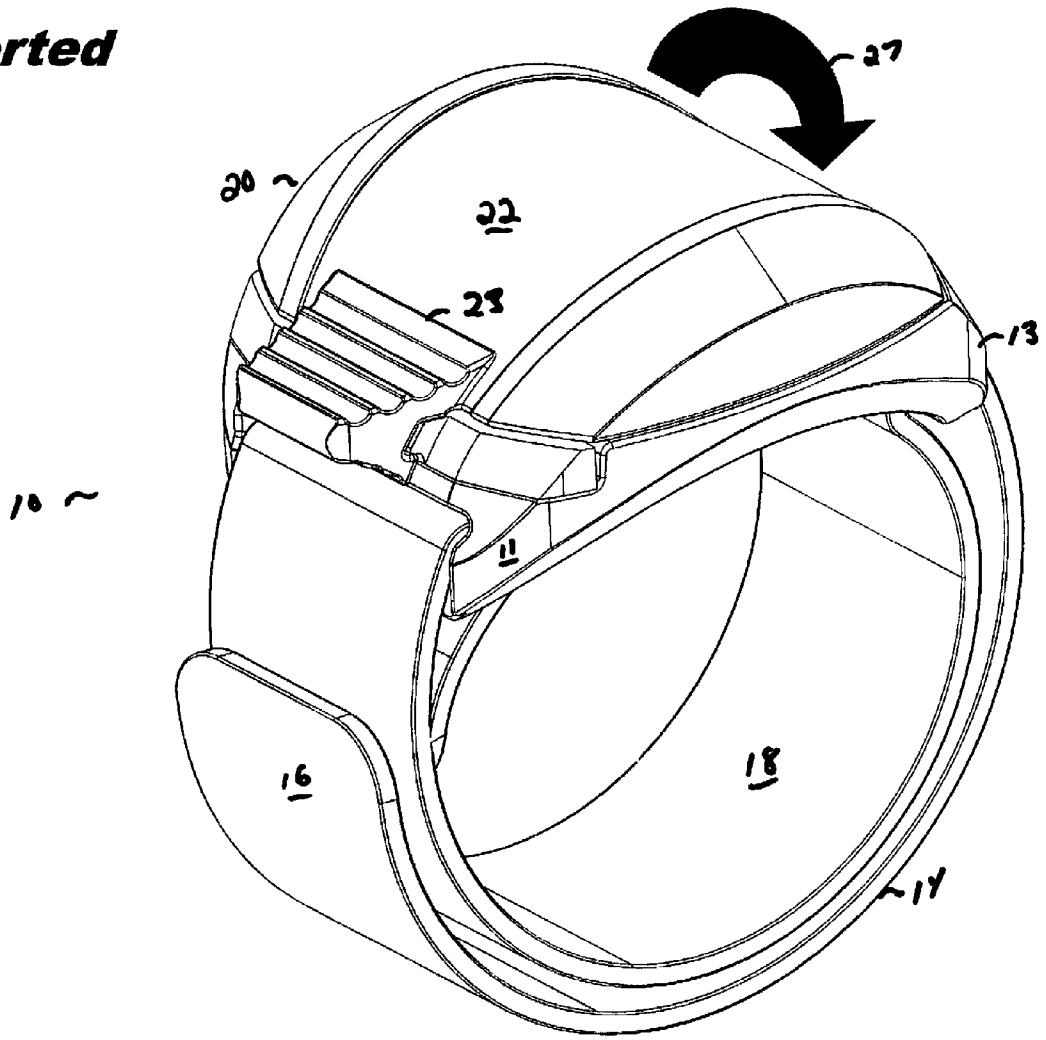
Figure 3:
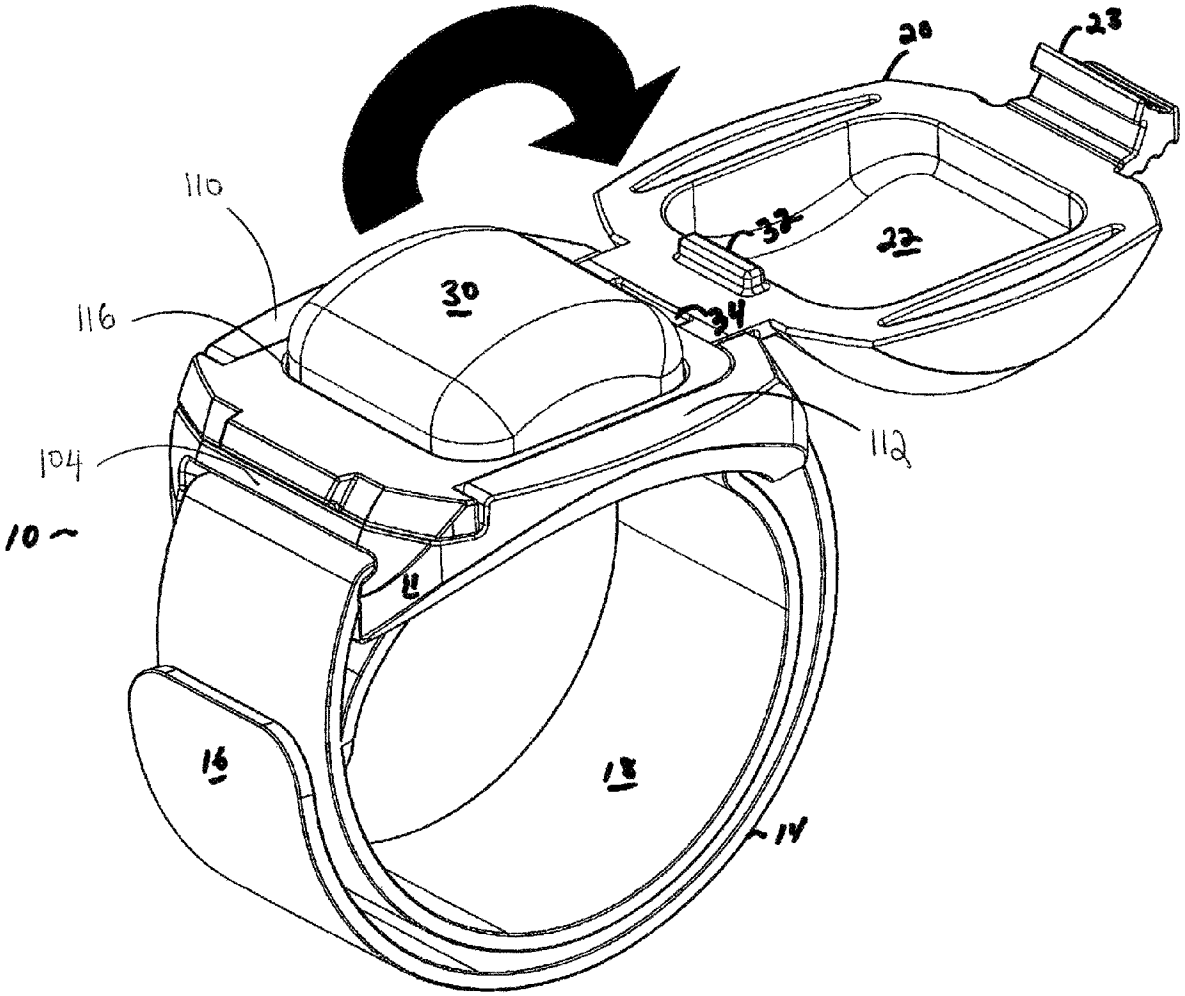

FIGS. 1 to 3 depict a preferred embodiment of a freshening ring 10 having a receptacle 12 for receiving a capsule shown later. The receptacle has a planar surface 100 with a top end 102 and a bottom end 104. Top end upright flanges 106, 108 are located at the top end 102 of the planar surface 100 while upright side flanges 110, 112 extend lengthwise on opposing sides of the planar surface 100 between top and bottom ends 102, 104 to form a capsule opening 114 in the bottom end 104. An adjustable flexible strap 14 has an exterior side 16 and interior side 18. The strap 14 is securely attached to receptacle 12 at buckle loop 11 and it is adjustably attached to the receptacle 12 at opposite buckle loop 13. In these figures, personal care capsule 20 having protective cover 22, a central compartment 116, a bottom side 118, and finger engagement element 23 is inserted into receptacle 12 at capsule opening 114 in the direction of arrow 25, and frictionally secured by tab 26.

Additionally depicted in FIG. 2, capsule 20 has been fully inserted in the receptacle and cap 22 is ready to be opened in the direction of arrow 27.

Figure 4:
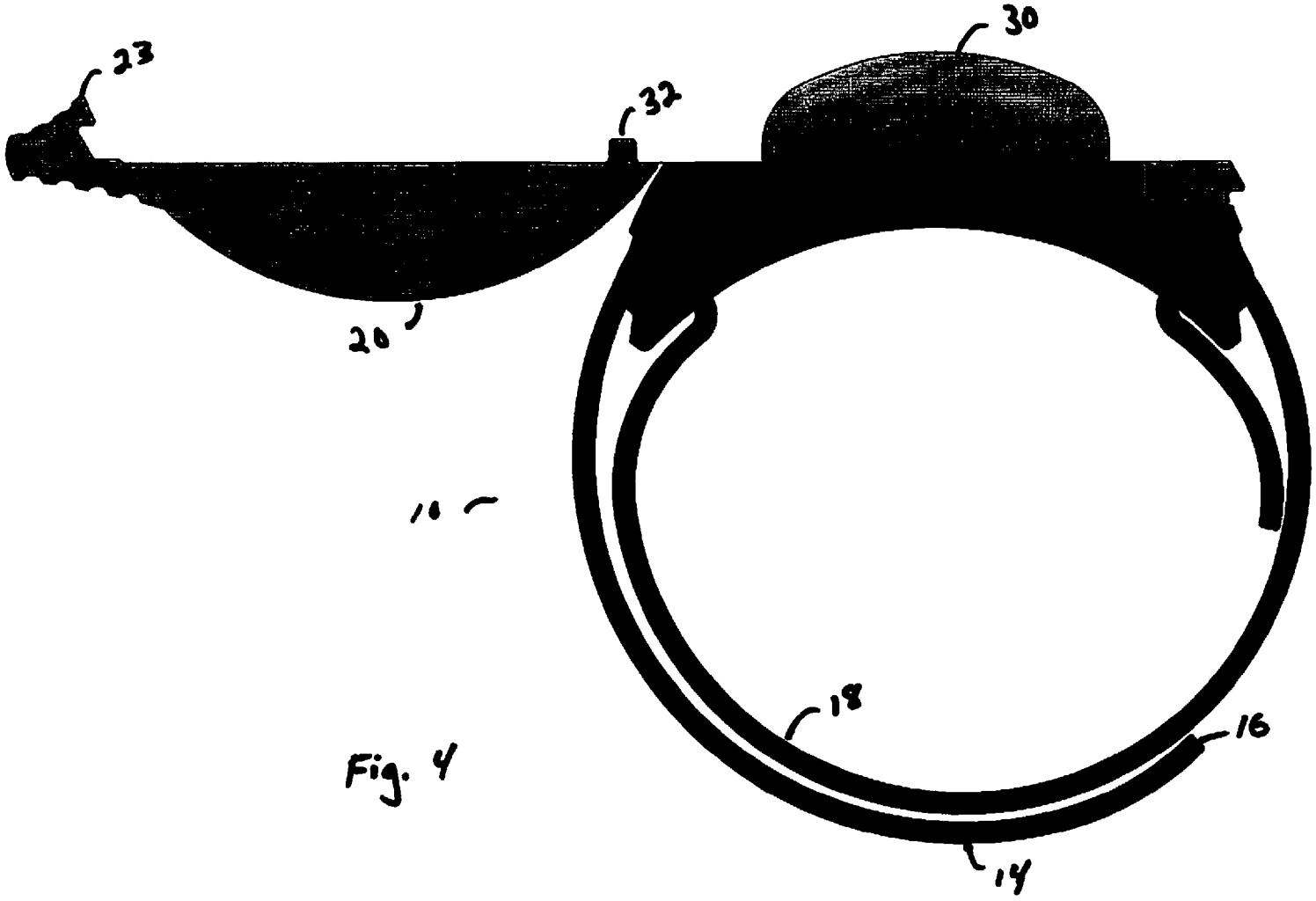
FIG. 4 depicts a side elevation view of the design shown in FIG. 3.

FIG. 3 depicts open cap 22, thereby exposing the personal care product 30 contained within the capsule. Also shown are hinge cap elements 32 and 34. FIG. 4 depicts a side elevation view of the design shown in FIG. 3.

FIG. 4 is an alternative view depicting similarly referenced elements.

Figure 5:
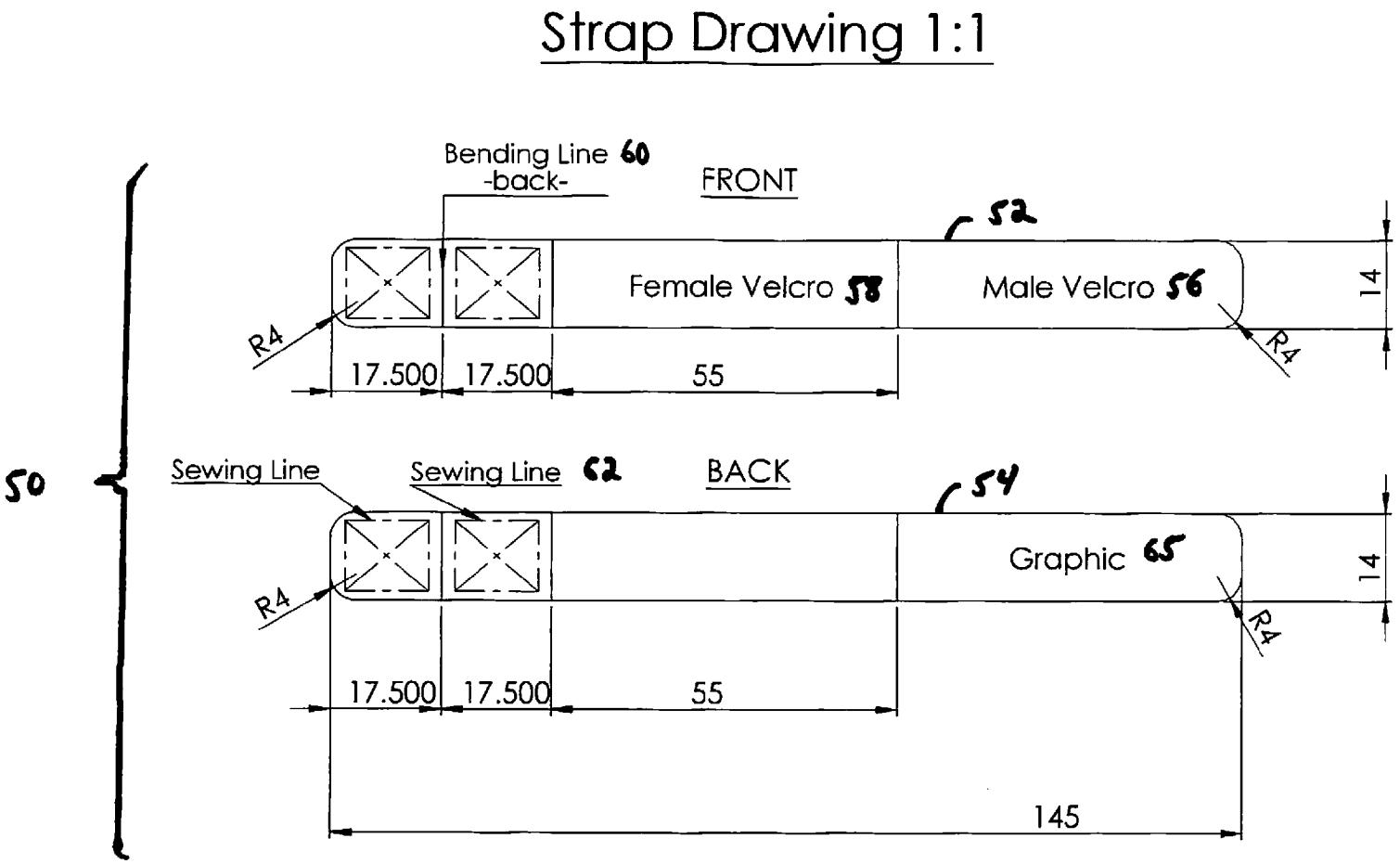
FIG. 5 depicts front and back views and dimensions in millimeters of an adjustable strap shown in the foregoing figures.

FIG. 5 depicts front and back views and dimensions in millimeters of an adjustable strap shown in the foregoing figures. In a preferred embodiment, adjustable strap 50 can be stitched at one end around a receptacle buckle loop and have adjustable hook and loop fastener elements at the opposite end of the strap.

The above described finger ring design may be functional, decorative or both. Precious metals may be used in jewelry applications, whereas cheaper metals or molded plastics may be used in less expensive designs, perhaps including disposable ring fresheners. Adjustable straps and fittings may be utilized in sporting applications such as running or bicycling. Accordingly, other designs included within the scope of this disclosure would incorporate the freshening personal care product compartment within a finger sleeve of an outdoor glove (e.g. ski gloves). Such gloves may be designed to include a ring portion comprising the adjustable holder (or container) for the freshening agent, and a cap for exposing the freshening agent so that the agent may be readily available. Furthermore a glove adapted to include a finger opening would permit the user to wear the earlier described freshening ring with most types of gloves currently available. Many complementary variations are also contemplated.

The invention now being fully described, it will be apparent to one of ordinary skill in the art that many changes and modifications can be made thereto without departing from the spirit or scope of the invention as set forth herein.

The invention claimed is:

1. A wearable ring assembly for wearing on a finger of the wearer's hand comprising:

a. a fixed or flexible ring shank portion, integrally or mechanically connected to b. a rectangular personal care product receptacle having a planar surface, a pair of upright side flanges and a tab, wherein the pair of upright side flanges are disposed on opposing sides of the planar surface and further, wherein the tab is disposed on the planar surface; and c. a replaceable capsule comprising a central compartment, wherein the central compartment is configured to be slidably insertable in the receptacle between the pair of upright side flanges and over the tab so that the capsule is held in place by the upright side flanges and is frictionally secured by the tab, and further, wherein the capsule is configured to contain a personal care product.

2. The wearable ring assembly of claim 1 wherein the ring shank portion is adjustable to fit a wearer's finger.

3. The wearable ring assembly of claim 1 wherein the ring shank portion is made from precious metals.

4. The wearable ring assembly of claim 1 wherein the ring shank portion is made from materials selected from the group consisting of non-precious metals, thermo-formable plastic resins, ceramics, rubber, woven, flexible plastic and leather materials.

5. The wearable ring assembly of claim 1 wherein the capsule further comprises a cap.

6. The wearable ring assembly of claim 5 wherein the cap is hinged to the capsule.

7. The wearable ring assembly of claim 6 wherein the capsule has at least one finger engagement element aiding in hinging the cap.

8. The wearable ring assembly of claim 1 wherein the ring shank portion is an adjustable strap having hook and loop fastener elements.

9. The wearable ring assembly of claim 8 wherein the fixed or flexible ring shank portion further comprises a buckle loop, wherein the adjustable strap is secured to the buckle loop.

10. A wearable ring assembly for dispensing a personal care product, comprising:

a fixed or flexible ring shank portion, integrally or mechanically connected to a rectangular personal care product receptacle including a planar surface having a top end and a bottom end, a first top end upright flange located at said top end of said planar surface, a pair of upright side flanges which extend lengthwise on opposing sides of said planar surface between said top and bottom ends and form a capsule opening in said bottom end, and a tab which projects outward from said planar surface;

a rectangular replaceable capsule having a central compartment which is slidably insertable into said capsule opening, wherein said capsule is secured in position in said receptacle by said pair of upright side flanges, said first top end upright flange, and said tab which frictionally engages a bottom side of said receptacle;

said capsule including a cap hinged to said central compartment.

11. The wearable ring assembly of claim 10, further comprising a second top end upright flange located at said top end of said planar surface.

12. The wearable ring assembly of claim 11, wherein said capsule has at least one finger engagement element aiding in hinging the cap.

* * * * *